US009260275B2

(12) United States Patent
Reuter et al.

(10) Patent No.: US 9,260,275 B2
(45) Date of Patent: Feb. 16, 2016

(54) DEVICE FOR ENTRAINING A SHAFT DOOR BY MEANS OF AN ELEVATOR CAR DOOR

(75) Inventors: Guenter Reuter, Filderstadt (DE); Gerald Steinz, Stuttgart (DE); Thomas Netzer, Stuttgart (DE); Aleksandr Gentner, Neuhausen (DE); Petros Burutjis, Eningen unter Achalm (DE); Adam Kolasinski, Kirchheim (DE)

(73) Assignee: Thyssenkrupp Elevator AG, Dusseldorf (DE)

( * ) Notice: Subject to any disclaimer, the term of this patent is extended or adjusted under 35 U.S.C. 154(b) by 491 days.

(21) Appl. No.: 13/526,245

(22) Filed: Jun. 18, 2012

(65) Prior Publication Data

US 2013/0133985 A1 May 30, 2013

Related U.S. Application Data

(63) Continuation of application No. PCT/EP2010/061911, filed on Aug. 16, 2010.

(30) Foreign Application Priority Data

Dec. 16, 2009 (EP) ..... 09179529

(51) Int. Cl.
*B66B 13/12* (2006.01)

(52) U.S. Cl.
CPC ..... *B66B 13/12* (2013.01); *B66B 13/125* (2013.01)

(58) Field of Classification Search
CPC .... B66B 13/12; E05F 17/00; E05F 2017/005; E05F 2017/007; E05F 17/004
USPC ..... 187/319, 330; 49/119, 120, 370
See application file for complete search history.

(56) References Cited

U.S. PATENT DOCUMENTS

| | | | | | |
|---|---|---|---|---|---|
| 3,638,762 | A * | 2/1972 | Johns | ..... | 187/319 |
| 5,246,089 | A * | 9/1993 | Husmann et al. | ..... | 187/319 |
| 5,544,720 | A * | 8/1996 | Spiess | ..... | 187/319 |
| 5,575,357 | A * | 11/1996 | Spiess | ..... | 187/319 |
| 5,636,715 | A * | 6/1997 | Hayashi et al. | ..... | 187/330 |
| 5,732,796 | A * | 3/1998 | Ahigian et al. | ..... | 187/314 |
| 5,988,320 | A * | 11/1999 | Mittermayr | ..... | 187/319 |
| 7,077,242 | B2 * | 7/2006 | Cocher | ..... | 187/330 |
| 7,100,745 | B2 * | 9/2006 | Bisang et al. | ..... | 187/330 |
| 7,464,794 | B2 * | 12/2008 | Badaoui et al. | ..... | 187/330 |

FOREIGN PATENT DOCUMENTS

| | | | | | |
|---|---|---|---|---|---|
| EP | 744373 | A2 * | 11/1996 | ..... | B66B 13/12 |
| EP | 2650249 | A1 * | 6/2005 | ..... | B66B 13/12 |
| EP | 2543618 | A1 * | 1/2013 | ..... | B66B 13/12 |
| FR | 2827266 | A1 * | 1/2003 | ..... | B66B 13/12 |
| JP | 2005170680 | A | 6/2005 | | |
| JP | 2007112544 | A | 5/2007 | | |
| JP | 2011063384 | A * | 3/2011 | ..... | B66B 13/12 |

* cited by examiner

*Primary Examiner* — William A Rivera
*Assistant Examiner* — Stefan Kruer
(74) *Attorney, Agent, or Firm* — Lathrop & Gage LLP

(57) ABSTRACT

The present invention relates to a coupling gear device for entraining a shaft door by means of an elevator car door that can be actuated by a door drive for elevator devices, comprising entrainment means (110) provided on the side of the elevator car door and counter entrainment means (210) arranged on the side of the shaft door. The counter entrainment means can be acted on by the entrainment means (110) for entraining the shaft door, wherein the entrainment means (110) and/or the counter entrainment means (210) can be lowered at least partially in the elevator car door or the shaft door.

11 Claims, 9 Drawing Sheets

DEVICE FOR ENTRAINING A SHAFT DOOR BY MEANS OF AN ELEVATOR CAR DOOR

RELATED APPLICATIONS

This application is a continuation of PCT Patent Application Serial No. PCT/EP2010/061911, filed Aug. 16, 2010, which claims priority to European Patent Application 09179529.4, filed Dec. 16, 2009, the disclosures of which are incorporated herein by reference.

BACKGROUND

The present invention relates to a device for entraining a shaft door by means of a lift car door according to the preamble of claim 1. A device of this type is also called a coupling gearing.

Lift doors usually have a door provided on the lift car as well as shaft doors provided at each floor. When the lift car approaches a floor, it is necessary for both the lift car door and the corresponding shaft door (then positioned behind the lift car door) to be opened and closed to allow passengers to get into and out of the lift and to allow the lift car to continue on its way.

A lift car door usually has a drive by which it can be opened and closed. To avoid corresponding drives for every shaft door, the lift car door is configured with a catch or entrainment mechanism which, when the lift car arrives at a floor, engages in a corresponding counter-catch of the shaft door and also opens and closes the shaft door. In this respect, expanding hook bolt mechanisms are usually used, as described, for example, in EP 0 744 373 B1.

A disadvantage of the mechanism described in that document is that when the lift car moves, the catch and counter-catch project into the threshold spacing, i.e. into the spacing between shaft door threshold and lift car door threshold, which can result in rattling and wind noises when the lift car moves relatively fast, because for example when passing through a floor (without stopping), the catch and counter-catch are moved very closely past one another. In other words, the effective spacing between lift car door and shaft door is significantly smaller than the threshold spacing.

In particular in the case of a so-called high-power lift car door, it is essential to prevent rattling and wind noise at very fast travelling speeds. Furthermore, lift doors of this type are to open and close as fast as possible.

SUMMARY OF THE INVENTION

The present invention proposes a device (coupling gearing device) It is considered to be a particular advantage of the device according to the invention that the threshold spacing between shaft door and lift car door can be substantially utilised in an optimum manner due to the provided displaceability of the catch means and the counter-catch means, arranged on the lift car side and/or on the shaft side, during the travel of the car, in particular when passing through a floor without stopping.

The provided mechanism also proves to be actuatable in a fast and reliable manner, thereby ensuring a fast opening and closing of the lift car door and shaft door. Thus, the device according to the invention is a highly effective coupling gearing for lift car door and shaft door.

Advantageous configurations of the device according to the invention are the subject matter of the dependent claims.

According to a particularly preferred embodiment of the device according to the invention, the catch means are configured to be extensible and can be at least partly submerged into the shaft door to act upon the counter-catch means. This construction allows a particularly simple configuration of the counter-catch means, it being possible at the same time for the threshold spacing, i.e. the distance between lift car door threshold and shaft door threshold to be maximised.

The catch means on the lift car door side are expediently configured as expander skates expander skate angles. Expander skate angles of this type have a sufficient longitudinal extension such that it is possible to realise a relatively great tolerance range with respect to the position of the lift car on initiating the coupling between shaft door and lift car door.

The counter-catch means on the shaft door side are preferably configured as rollers. Rollers of this type prove to be unsusceptible to rattling and require little maintenance.

The device according to the invention expediently has a locking mechanism which cooperates with the counter-catch means to lock the shaft door, it being possible for the locking mechanism to be unlocked when the catch means acts on the counter-catch means. A locking mechanism of this type is usually prescribed by law. Locking and unlocking operations using the device provided according to the invention proves not to be complex in mechanical terms.

When the catch means act on the counter-catch means, the catch means are expediently initially moved vertically and then parallel to the threshold leading edges of the lift car door and shaft door. It is possible to realise movements of this type in a particularly simple manner by the mechanism portrayed in the description of the figures.

For this purpose, the device according to the invention preferably has a carriage on the lift car side which can be moved on a lift car door by a drive, said carriage being configured with rollers which are moved during displacement by a connecting link of a guide unit, the catch means being coupled with the guide unit such that a movement of the rollers by the connecting link results in the catch means extending with respect to the lift car door. A mechanism of this type with a displaceable carriage, the rollers of which can be moved by a connecting link, permits a very precise and reliable mobility of the catch means, in particular of the expander skates. The drive is preferably configured as a belt drive, for example with a toothed belt, as a cable pull, a spindle drive or as a purely electrical drive, for example a linear motor.

The drive which is used is preferably configured to be self-locking or non-self-locking. As a result of providing self-locking means, for example by providing corresponding inclination angles and/or surface roughnesses in the case of a spindle drive, it is possible to prevent an automatic or self-acting coupling of lift car door and shaft door. For specific requirements, for example in emergencies, it can also be advantageous to do without such a self-locking so that the lift car door and shaft door can engage with one another even if a power failure occurs. If an engagement of this type is always guaranteed during a power failure, then opening the doors, for example for rescue services, is also simplified.

In particular, a drive used according to the invention can also be configured to be programmable, so that adapting, for example to mechanical characteristics of the device, for example in the form of connecting links and/or restricted guidance means, is possible.

This mechanism also advantageously has a driver (engaging element) which is provided on the carriage and which, upon a further movement by the carriage, acts on a lever, configured on the catch means, thereby causing the catch means to spread apart. A spreading apart of two expander skate angles arranged substantially parallel by a lever mechanism of this type proves to be very precise, and simultaneously ensuring a mechanical robustness. In this respect, it is particularly advantageous for the lever to be configured with corresponding means, for example with rollers which allow mobility in a corresponding connecting link.

The device according to the invention is characterised, inter alia, in that a one-dimensional movement provided by a drive can be converted into a complex movement, i.e. into a movement which acts in a plurality of directions by mechanical means, in particular by the mentioned connecting links or restricted guidance means. The mechanical means provided according to the invention prove to be reliable and maintenance-free.

According to a particularly preferred embodiment of the invention, a lift car door lock on the lift car door side is provided which can be actuated by actuating means provided on the shaft door side. A lift car door locking mechanism of this type ensures that the lift car door can only be opened when it is aligned relative to a shaft door, i.e. when the lift car is located at a floor. The mechanism provided according to the invention for locking the lift car door is characterised in that it is configured such that, corresponding to the catch means, it can be extended relative to the shaft door. Thus, a lift car door lock is also ensured according to the invention, while guaranteeing a maximum threshold spacing between the lift car door and the shaft door.

In a particularly advantageous manner, the lift car door lock is configured together with the catch means to be extensible. In particular, this means that some of the components of the lift car door lock utilise the movement of the catch means (i.e. they follow said movement) in order, for their part, to extend relative to a shaft door. Therefore, the lift car door lock does not require its own drive. In this respect, some of the components of the lift car door lock are configured such that they cannot be extended, while further components create the extensibility of the lift car door lock.

According to a particularly preferred embodiment, the lift car door lock has a hook bolt, a connecting rod and a locking lever, these elements being configured to be non-extensible, and also has a driving roller, a driving lever and a locking skate angle, these elements being configured to be extensible. In utilising the extension and widening movement of the catch means, a mechanism of this type proves to be mechanically sturdy, satisfying highest safety requirements.

In a particularly advantageous manner, a lift comprises a device according to the invention.

It is understood that the features which have been mentioned above and those which will be described in the following can not only be used in the combination stated in each case, but also in other combinations or on their own, without thereby departing from the scope of the present invention.

BRIEF DESCRIPTION OF THE DRAWINGS

Preferred embodiments of the invention will now be described in more detail with reference to the accompanying drawings, in which.

DETAILED DESCRIPTION OF THE INVENTION

Figure 2C:
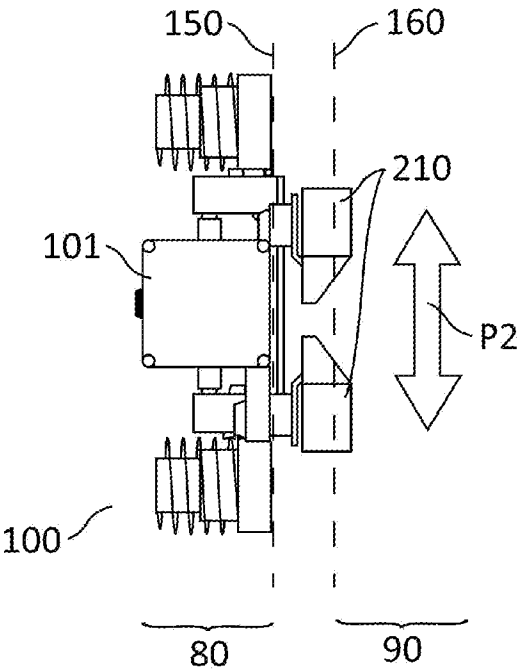
FIGS. 2*a* to 2*c* are views of the catch means according to FIG. 1 from above, in each case in different operating positions, together with a preferred embodiment of the counter-catch means on the shaft door side.
Figure 2B:
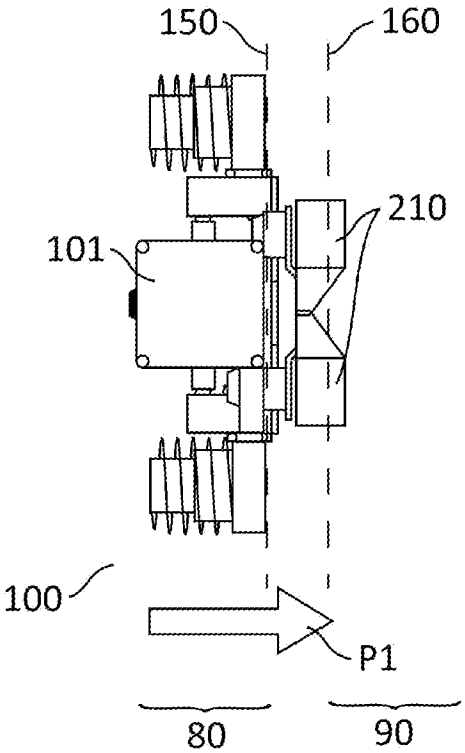
Figure 2A:
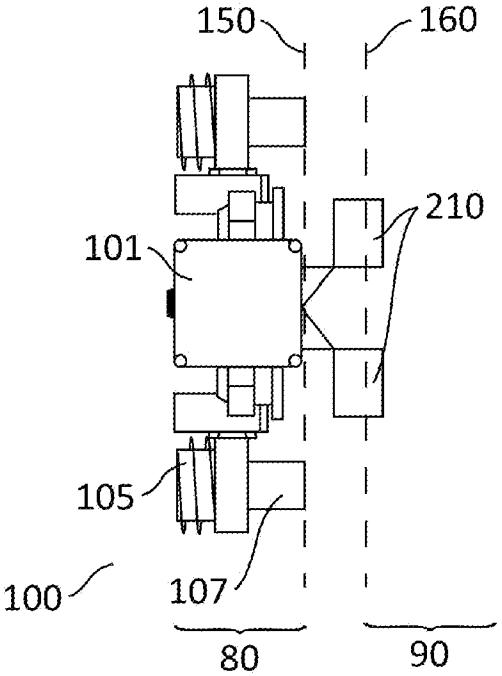

The illustrated first embodiment of the device according to the invention is identified overall by reference numeral 100 in FIGS. 2*a* to 2*c*.

The device 100 serves to couple a lift car door with a shaft door of a lift. The lift car door and shaft door are only shown schematically in FIGS. 2*a* to 2*c* by means of parentheses and are identified by reference numeral 80 and respectively 90. By means of the coupling provided by the device 100 between lift car door 80 and shaft door 90, only the lift car door 80 has to be configured with a door drive (not shown) which opens and closes the lift car door. By virtue of the coupling, the respective shaft doors do not have to be provided with their own drives.

The device 100 has on the lift car door side two expander skate angles 110 which cooperate with rollers 210 attached on the shaft door side for coupling the lift car door and shaft door, as described later on. Thus, the expander skate angles 110 constitute catch means and the rollers 210 constitute counter-catch means in the context of the invention.

The device 100 also has on the lift car door side a drive 101 (see in particular FIG. 1) which is connected to a carriage 102 and is used to move this carriage 102 upwards and downwards on the lift car door.

The carriage 102 is connected to the lift car door (not shown in FIG. 1) by means of an axial mounting 107 and exclusively follows the upwards and downwards movement of the drive 101.

A downwards movement of the carriage 102 causes the expander skate angles 110 to extend (i.e. a displacement in the direction of the shaft door, see arrow P1 in FIG. 2*b*) and to widen (expand) (i.e. a pushing-apart movement parallel to the shaft door, see the double arrow P2 in FIG. 2*c*) whereas conversely the upwards movement causes the expander skate angles 110 to fold and retract, as will be explained in more detail in the following.

The carriage 102 is configured with rollers 108. These rollers 108 are attached to the carriage 102 and follow the upwards and downwards movement of the carriage 102. During this upwards and downwards movement, the rollers 108 travel along a connecting link 109*a* of a guide unit 109. The connecting link 109*a* has a first inclined portion 109*b* and a second flat portion 109*c*.

A base body 110*a* of the expander skate angles 110 is attached to the guide unit 109. The axial mounting 107 is rigidly connected to the lift car door, so that the guide unit 109 is freely mounted on the lift car door in the axial direction.

At least one expander skate angle 110 is configured with a lever 104 which, during a downwards movement of the carriage 102, is acted upon by a driver 103 provided on the carriage 102.

Figure 1:
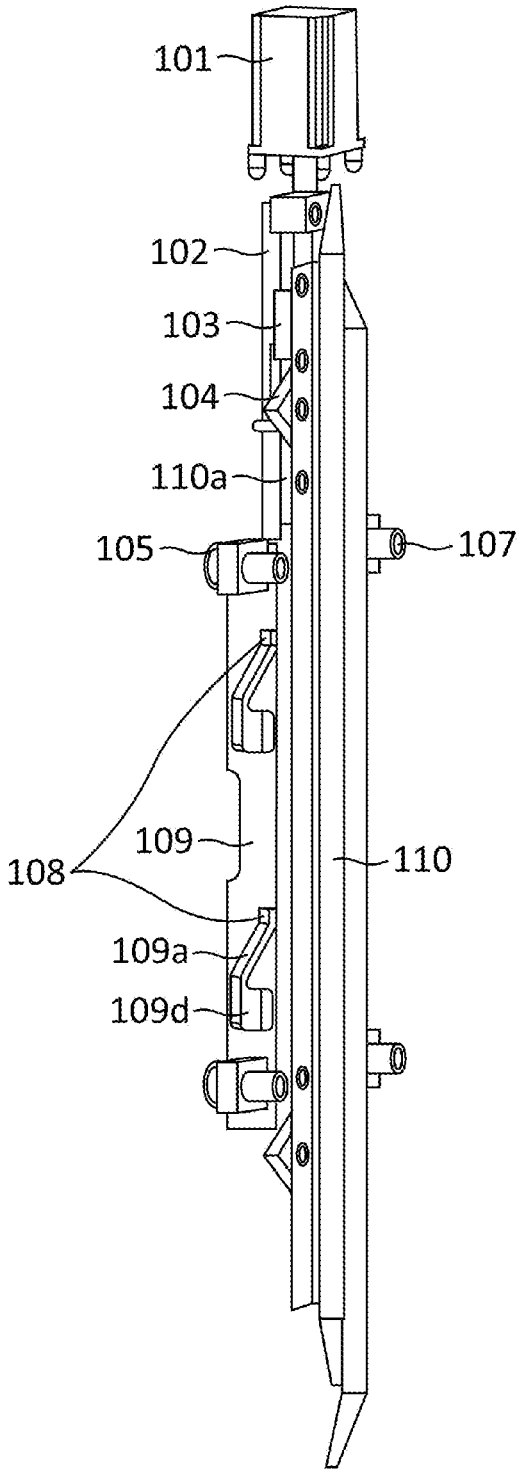
FIG. 1 is a perspective general view of a first preferred embodiment of the components or catch (engaging) means on the lift car side of a device according to the invention.
Figure 3C:
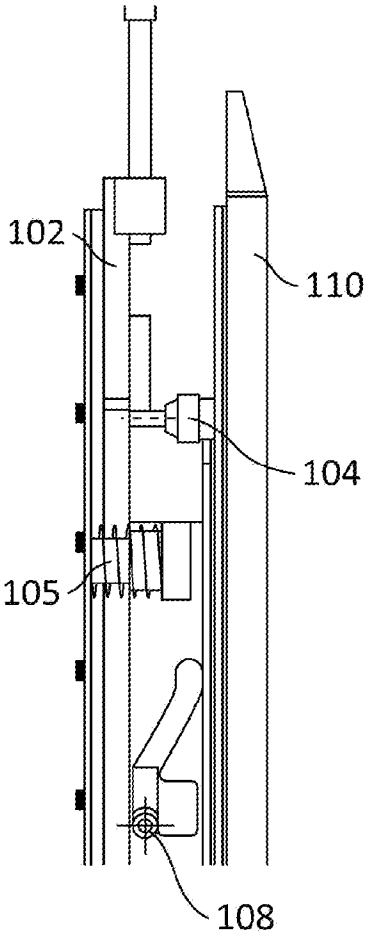
FIGS. 3*a* to 3*c* are side views corresponding to the operating positions of FIGS. 2*a* to 2*c*, but with only the catch means on the lift car side being shown.
Figure 3B:
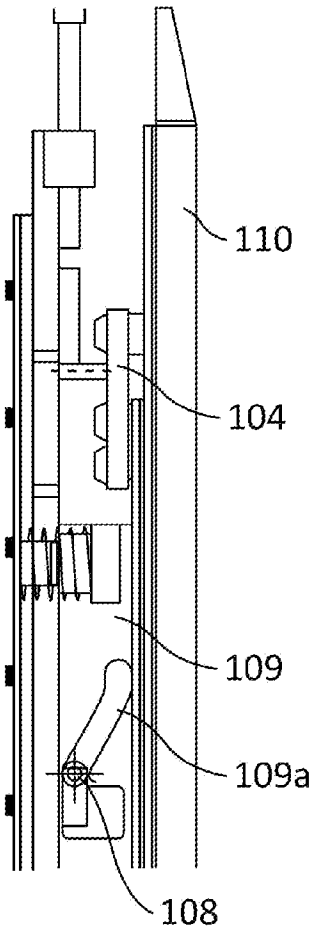
Figure 3A:
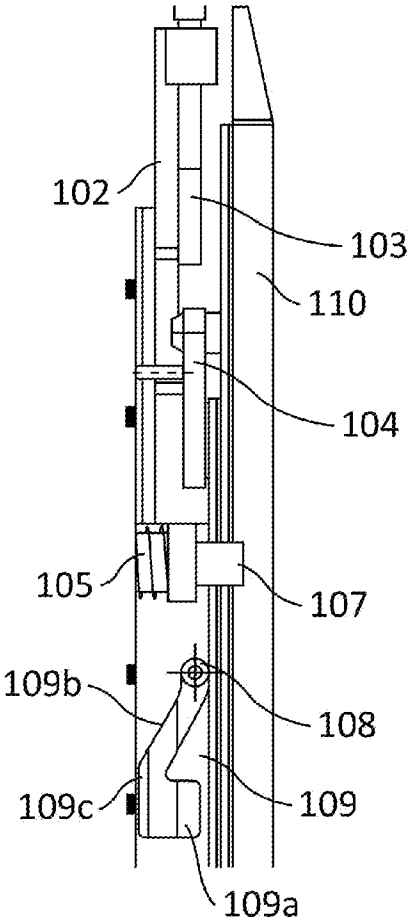

The mode of operation of the illustrated device 100 for extending, widening, folding and retracting the expander skate angles 110 is described in the following:

Starting from the position shown in FIG. 1 and in FIGS. 2*a* and 3*a*, the drive 101 initiates the downwards movement of the carriage 102 along the lift car door. The rollers 108 attached to the carriage 102 follow the downwards movement of the carriage 102, the rollers 108 travelling along the connecting link (or slotted element) 109*a* of the guide unit 109.

The rollers 108 initially travel along the inclined portion 109*b* of the connecting link 109*a*. The system consisting of expander skate angles 110 and guide unit 109 is released by the inclined portion 109*b* during the downwards movement of the carriage 102 so that the expander skate angles can be extended against the force of springs 105 provided on the mounting 107, i.e. in the direction of the rollers 210 on the shaft door side illustrated in FIGS. 2*a* to 2*c*.

By means of the illustrated configuration of the mounting, which is flexible due to the springs 105, of the expander skate angles 110 with respect to the lift car door, not only is the extension (and retraction) of the expander skate angles 110 possible, but so is a yielding of the expander skate angles 110 in the event of a collision with lift components provided on the shaft side. For this purpose, the connecting links 109*a* have widenings 109*d* in their lower region. Such collisions are possible, for example if the expander skate angles 110 extend prematurely due to a possible faulty operation.

When the rollers 108 have reached the transition from the inclined portion 109*b* to the flat portion 109*c* of the connecting link 109*a*, the expander skate angles 110 are fully extended. This state is shown in FIGS. 2*b* and 3*b*. It can be seen from FIG. 2*b* that the expander skate angles 110 are in this case (substantially) completely positioned between the rollers 210 of the shaft door.

During a further downwards movement of the carriage 102 and of the rollers 107 provided thereon, the rollers 108 move along the flat part 109*c* of the connecting link 109*a*. A further extension of the expander skate angles 110 is now not possible in this case. The widening movement of the expander skate angles 110 relative to one another is initiated during this part of the downwards movement.

For this purpose, during this further downwards movement, the driver 103 attached to the carriage 102 entrains a lever 104 of the respective expander skate angles, and thus initiates the expansion process. The two expander skate angles 110 which are each connected to the expander skate base body 110*a* by this lever 104 spread apart. This state is shown in FIGS. 2*c* and 3*c*. In this state, the lift car door and shaft door are coupled together by the coupling of expander skate angles 110 and rollers 210 such that an opening and closing of the lift car door by a drive (not shown) results in an entrainment, that is to say a simultaneous opening and closing of the shaft door.

The expansion process has ended when the drive 101 concludes the downwards movement, i.e. when the rollers 108 have reached the lower end point in the connecting link 109*a*.

In order to release the coupling between the lift car door and the shaft door, the described process has to be carried out in the reverse sequence. This is achieved by a corresponding upwards movement of the carriage 102 driven by the drive 101.

During the upwards movement, the carriage 102 slides upwards and the rollers 108 initially travel along the flat portion of the connecting link 109*a*. During this upwards movement, the contact between the respective levers 104 of the expander skate angles 110 and the driver (engaging element) 103 of the carriage 102 is released. As the result of a defined force which can be realised, for example as a spring, a weight or a forced entrainment, the expander skate angles 110 fold together again and once again reach the state shown in FIGS. 2*b* and 3*b*.

By moving the rollers 108 upwards along the inclined portion 109*b* of the connecting link 109, the expander skate angles 110 are then moved again into the position shown in FIG. 1, FIG. 2*a* and FIG. 3*a*. The force provided by springs 105 during extension then has to be overcome. It is pointed out in this connection that the defined force for extending the expander skate angles 110 does not necessarily have to be provided by means of a spring 105. Constructions with weights or restricted guidance means are also conceivable.

When the rollers 108 have reached the upper end of the connecting link 109*a*, the expander skate angles 110 are again folded and retracted, i.e. they are in their original state.

In the following, a further embodiment of the device according to the invention is illustrated with reference to FIGS. 4 to 6. This device substantially corresponds in functionality to the device described above. The same or similar components have been provided with the same reference numerals so that the above description can be applied analogously. In the following, essentially differences compared to the first embodiment described above will be described.

Figure 4:
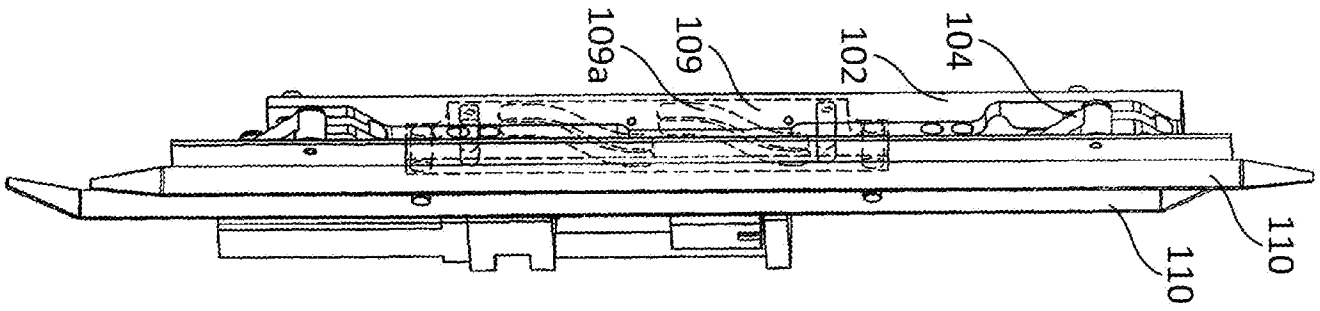
FIG. 4 is a view, corresponding to FIG. 1, of a further preferred embodiment of the components or catch means on the lift car side of a device according to the invention.

The device according to FIGS. 4 to 6 also has on the lift car door side two expander skate angles 110 which cooperate with rollers 210, attached on the shaft door side, for coupling the lift car door and the shaft door.

A carriage 102 configured with rollers 108 is also provided analogously to the first embodiment described above. A drive, as denoted according to the first embodiment by reference numeral 101, for moving the carriage 102 upwards and downwards on the lift car door, is not shown.

The connecting links 109*a* which are configured in an analogously provided guide unit 109, along which the rollers 108 travel during the upwards and downwards movement of the carriage 102, are configured overall with a uniform curvature compared to the first embodiment described above, thereby producing a more even extension movement of the expander skate angles 110 in the direction of the shaft door.

Figures 6A, 6B, 6C:
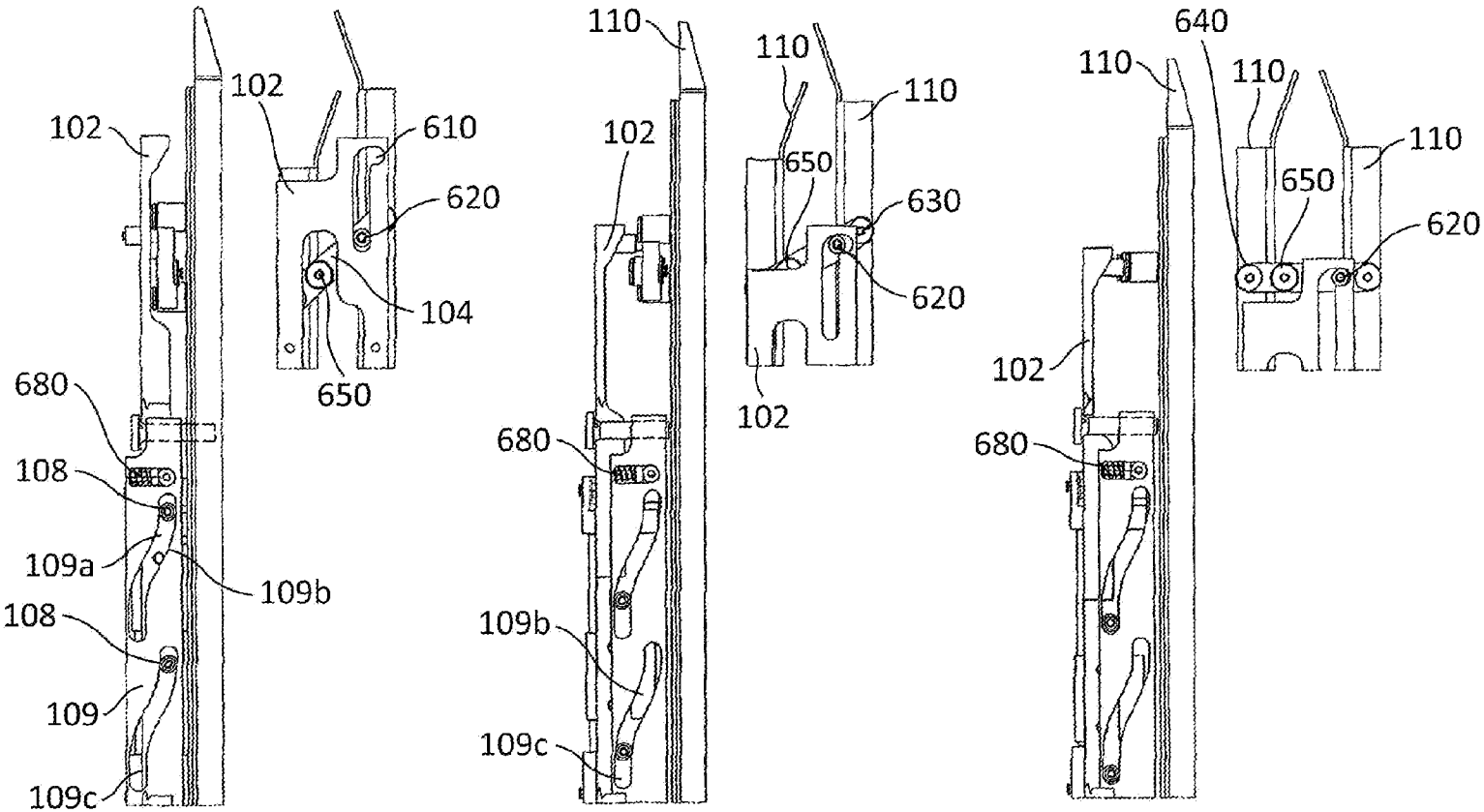
FIGS. 6*a* to 6*c* are side views or plan views corresponding to the operating positions of FIGS. 5*a* to 5*c*, but with only the catch means on the lift car side being shown, FIG. 6*a*' to 6*c*' are plan views corresponding to the operating positions of FIGS. 6*a* to 6*c*, FIGS. 7*a* to 7*c* are views, corresponding to FIGS. 5*a* to 5*c*, of a further preferred embodiment of the device according to the invention.

According to this embodiment as well, the expander skate angles 110 are acted on by at least one lever 104 which, during the downwards movement of the carriage 102, is guided in a further connecting link 610 (see FIG. 6*a*' to 6*c*').

Figure 5C:
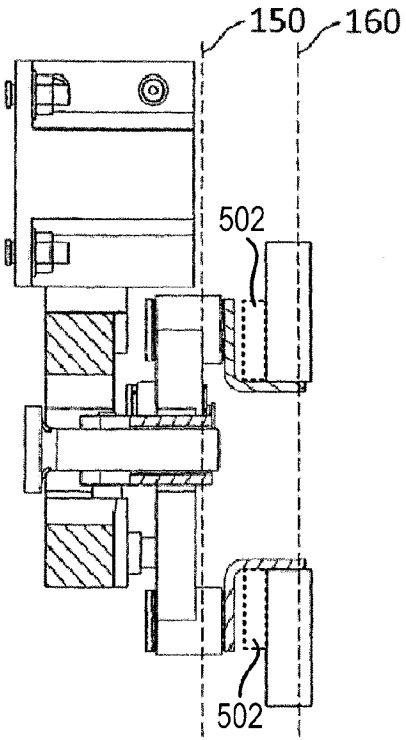
FIGS. 5*a* to 5*c* are views, corresponding to FIGS. 2*a* to 2*c*, of the catch means according to FIG. 4 together with a preferred embodiment of the counter-catch means on the shaft door side.

The mode of operation of the embodiment according to FIGS. 4 to 6 will now be described in more detail: starting from the position illustrated in FIGS. 4 and 5*a* and 6*a*, 6*a*', the drive (not shown here) initiates the downwards movement of the carriage 102 along the lift car door. The rollers attached to the carriage 102 follow the downwards movement of the carriage 102, the rollers 108 travelling along the connecting link 109*a* of the guide unit 109.

Figure 5B:
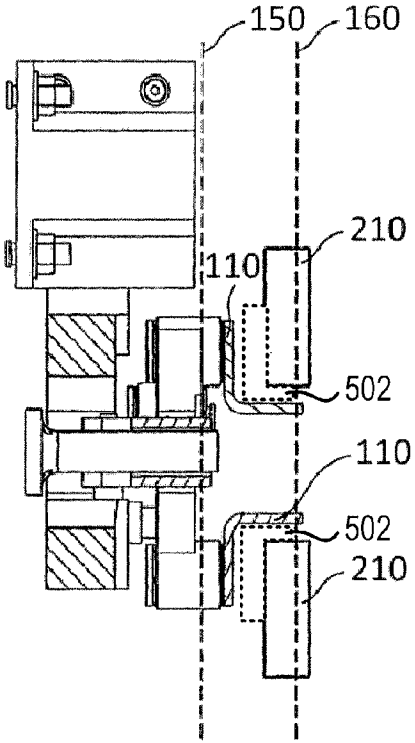
Figure 5A:
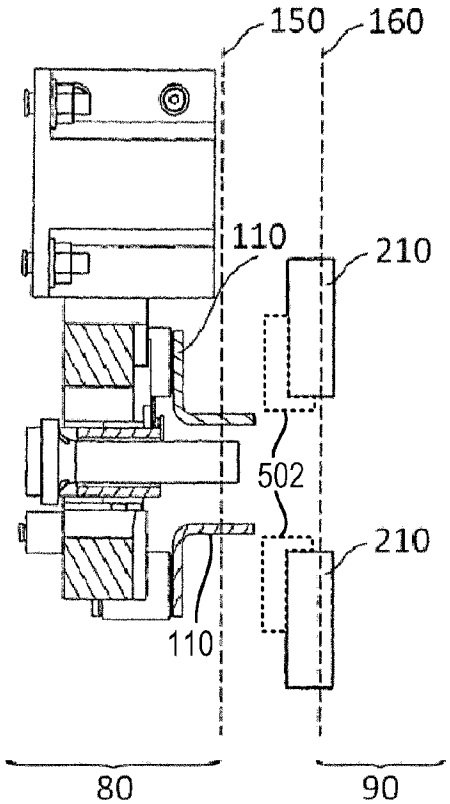

When travelling along the inclined portion 109*b* of the connecting link 109*a*, the expander skate angles 110 are in this case extended so that the position shown in FIGS. 5*b* and 6*b*, 6*b*' is reached.

When the rollers 108 have reached the transition from the inclined portion 109*b* to the lower flat portion 109*c* of the connecting link 109*a*, the expander skate angles 110 are fully extended in this embodiment as well (FIG. 5*b*, 6*b*, 6*b*').

During the further downwards movement of the carriage 102, the rollers 108 move along the lower flat part 109*c* of the connecting link 109*a*, the widening movement of the expander skate angles 110 relative to one another being initiated during this part of the downwards movement.

While the rollers 108 travel along the inclined portion 109*b* of the connecting links 109*a*, the further connecting link 610, provided in the upper portion of the carriage 102, slides along a roller 620 configured on the lever 104. In this respect, the purpose of the roller 620 is to guide the lever 104 in the connecting link 610. The lever 104 is mounted rotatably on a first expander skate angle 110 by its first end (at 630). At its second end (in the view of FIG. 6*a*' to 6*c*' at the left-hand end), the lever 104 is rotatably mounted on the further expander skate angle 110 (at 640). Advantageously, the lever 104 is able to pivot by means of a swiveling axis 650.

In the position shown in FIGS. 6*b* and 6*b*', the upper end 610*a* of the connecting link 610 impacts on the roller 620 so that during the further downwards movement of the carriage 102, the lever 104 thus pivots about the swiveling axis 650.

The lever is mounted rotatably overall such that during this further downwards movement, the two expander skate angles 110 spread apart.

Reaching the lower end of the connecting links 109 by the rollers 108 coincides with the horizontal orientation of the lever 104, shown in particular in FIG. 6*c*', at which the maximum widening of the expander skate angles 110 is also provided.

This horizontal arrangement of the lever 104 in this end state proves to be particularly favourable, since horizontal forces which are effective during a subsequent opening or closing of the lift car door and shaft door and which can act on the lever 104 are not transmitted onto the drive.

A comparison between the different connecting links 109 used in the two embodiments shows that the connecting links used in the first embodiment have a widening 109*d* in their lower portions which is not provided in the case of the connecting links 109*a* of the second embodiment. A yielding of the expander skate angles 110 in the event of a collision, for example with lift components provided on the shaft side, for instance in the case of a premature extension of the expander skate angles 110 due to a possible faulty operation is ensured in the second embodiment by means of a flexible mounting of the carriage 102 on a spring 680. According to the second embodiment, it is possible to dispense with springs 105, as provided in the first embodiment, as a result of the connecting links 109 which are configured as a restricted guidance.

The coupling between lift car door and shaft door which is provided in the position of FIGS. 5*c*, 6*c*, 6*c*', is released by correspondingly returning the components, as has already been described in detail with reference to the first embodiment.

It is also pointed out that, for safety reasons, a shaft door is usually locked by a locking mechanism. This measure means that it is impossible to open the shaft door during normal operation of the lift, if the lift car or lift car door is not positioned directly behind the shaft door.

A lock of this type can be coupled with the rollers 210, and can be released in the manner illustrated above as a result of the expander skate angles 110 acting on the rollers 210. Conversely this means that when the expander skate angles 110 have finished acting on the rollers 210, the locking mechanism is again effective. A shaft door locking mechanism of this type is not described in detail here.

The threshold leading edge of the lift car (identified by reference numeral 150) and the threshold leading edge of the shaft door (identified by reference numeral 160) are shown in FIGS. 2*a* to 2*c* and 5*a* to 5*c*, to further illustrate the advantages associated with the present invention. The gap between these two edges 150, 160 is called the threshold spacing.

For example, it can be seen in FIG. 2*a* that the expander skate angles 110 in the uncoupled state shown here partly project into the threshold spacing from the threshold leading edge 150 of the lift car door and are partly submerged in the lift car door. The same applies to the rollers 210 with respect to the threshold leading edge 160 of the shaft door. This partial submergence can maximise the spacing between catch means on the lift car side (here expander skate angles 110) and counter-catch means on the shaft side (here rollers 210). Since in conventional solutions, catch means and counter-catch means are in each case the components which project furthest into the threshold spacing, according to the invention it is possible to increase the effective threshold spacing compared to these conventional solutions. The term "effective threshold spacing" is understood here as meaning the minimum spacing between components provided on the shaft side and components provided on the lift car side.

The described mobility of the expander skate angles 110 advantageously makes it possible for the rollers 210 to be fully submerged in the shaft door, i.e. for the rollers 210 to be arranged fully on the right-hand side of the threshold leading edge 160 in the view of FIG. 2*a*. As an alternative or in addition, it is also possible to fully submerge the expander skate angles 110 in the lift car door while the lift car is moving in the lift shaft, i.e. positioned fully on the left-hand side of the threshold leading edge 150 in the view of FIG. 2*a*. These measures can further optimise, in particular can maximise, the effective spacing between expander skate angles 110 and rollers 210 while the lift car is moving in the lift shaft. In particular in the case of high-powered lift cars which move at a very high speed through the lift shaft, the partial submergence of expander skate angles 110 and/or of rollers 210 in the lift car door and respectively in the shaft door can effectively prevent rattling and wind noises which are produced when the spacing between the components on the lift car side and the components on the shaft side (here expander skate angles and rollers) is too small.

The device according to the invention can advantageously be freely positioned, for example in the case of glass doors, it can be positioned to the side of the respective door openings. It is also possible to position the device above or below the door opening. The device according to the invention is advantageously arranged at the centre of gravity or in the vicinity of the centre of gravity of the door, as is also known from the prior art. Particularly in the case of high-speed doors, this measure is in particular effective with regard to the prevention of rattling noises.

A further preferred embodiment of the invention will now be described with reference to FIGS. 7 to 9.

In addition to the coupling function described according to the embodiments illustrated above, this embodiment has a further function, namely a lift car door lock.

In this embodiment as well, the same or similar components are again provided with the same reference numerals, as used with respect to the embodiments above.

A lift car door lock ensures that a lift car door can (usually) only be opened when the lift car door is coupled with a shaft door (as described above), so that consequently, the lift car door and shaft door can only be opened and closed together.

The preferred embodiment, illustrated in the figures, of a lift car door lock firstly has on the lift car door 80 (again shown schematically) a hook bolt 701, a connecting rod 702 and a locking lever 703. These elements are attached on the lift car door side and cannot be extended with respect to a shaft door 90 which is also shown schematically here (FIGS. 7*a* to 7*c*).

As extensible elements which, (together with the coupling mechanism described in detail above) can be extended in the direction of the shaft door 90, the lift car door lock also has a driving (engaging) roller 704, a driving (engaging) lever 705 and a further skate angle, identified in the following as a locking skate angle 706, and also expediently a lower bearing lever 707.

Figure 8C:
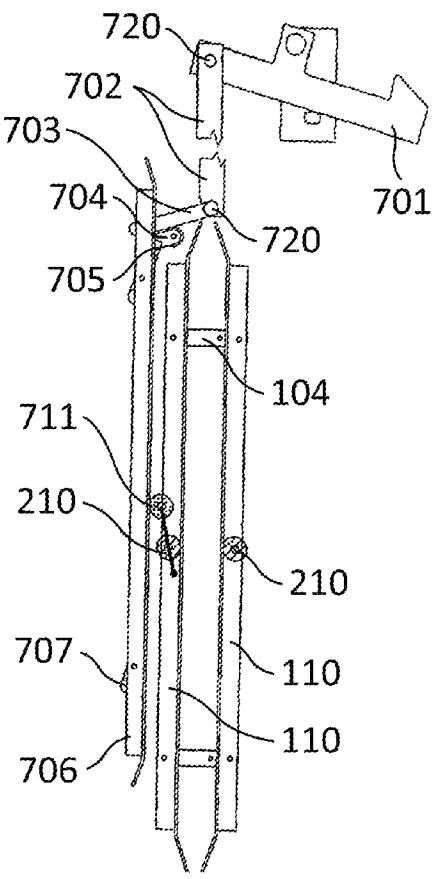
FIGS. 8*a* to 8*c* are views, corresponding to FIG. 6*a*' to 6*c*' of the embodiment according to FIGS. 7*a* to 7*c*, and FIGS. 9*a* to 9*c* are partial views, corresponding to FIGS. 6*a* to 6*c* of the embodiment according to FIGS. 7*a* to 7*c*.
Figure 8B:
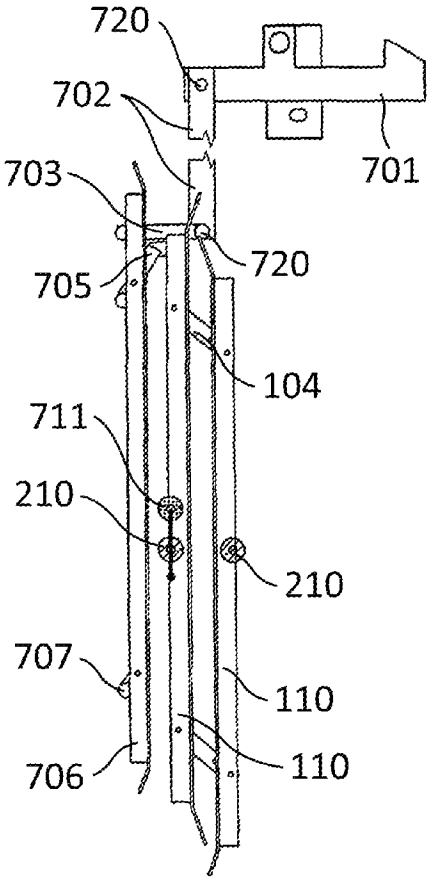
Figure 8A:
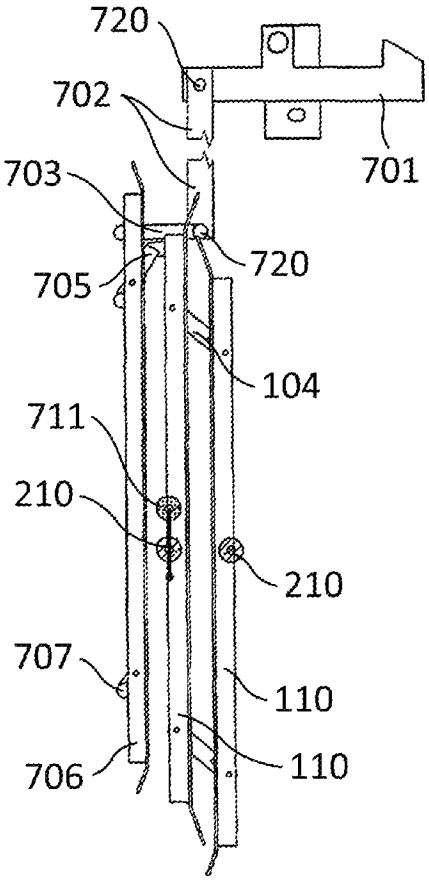
Figure 9C:
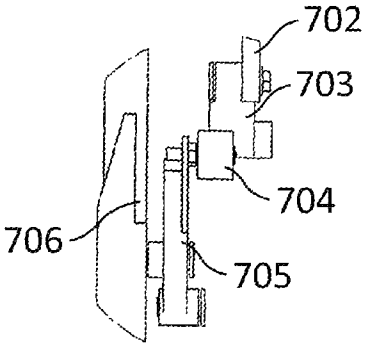
Figure 9B:
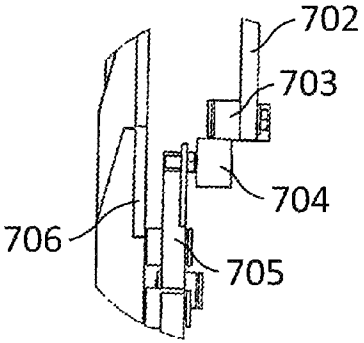
Figure 9A:
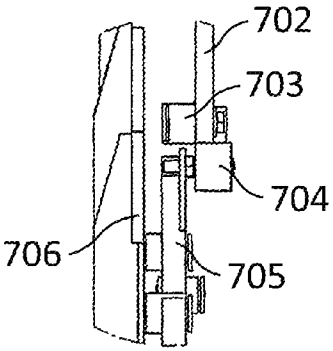

Provided on the shaft door side as an actuating means for this lift car door lock is a further roller 711 which is preferably configured vertically under one of the rollers 210 of the counter-catch means when the lift car door and shaft door are not coupled, as can be seen in particular in FIGS. 8*a*-8*c*.

Figure 7C:
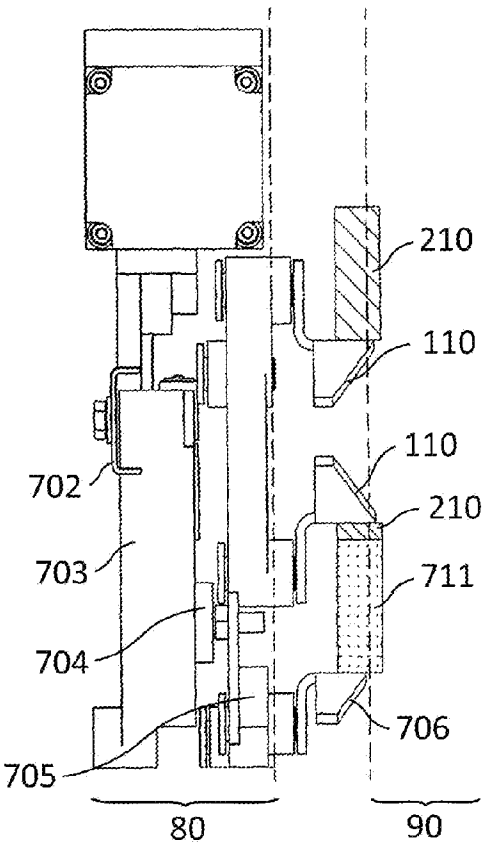
Figure 7B:
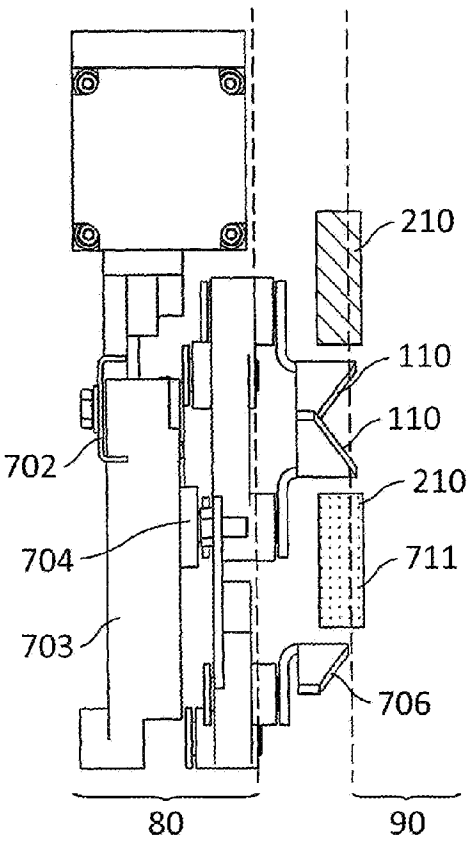
Figure 7A:
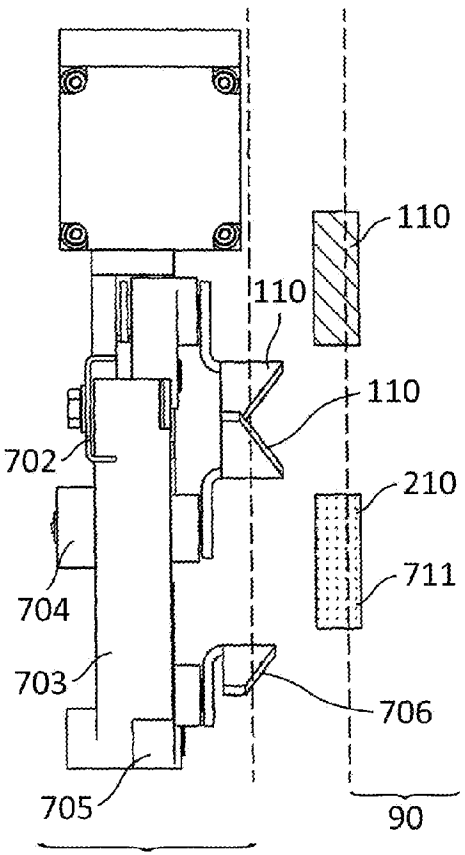

The extensible elements of the lift car door lock (driving roller 104, driving lever 105, locking skate angle 106 and lower bearing lever 107) are connected to the extensible elements of the coupling mechanism such that they participate in the extending movement of the coupling mechanism, as can be seen in particular from FIGS. 7*a* to 7*c*. In this respect, the spacing between the catch means, in particular the expander skate angles 110 and the counter-catch means, i.e. the rollers 210, is reduced until the expander skate angles 110 are positioned between the rollers 210 (analogously, for example to FIG. 5*c*). The spacing between the extensible locking skate angle 106 and the roller 711 is reduced to the same extent, as can be seen in particular from FIGS. 7*a*, 7*b*.

As described above in detail, the contact between the expander skate angles 110 and the rollers 210 is produced during the subsequent widening movement of the expander skate angles 110 (FIG. 7*c*, 8*c*, 9*c*), with the shaft door also being unlocked (by a mechanism which is not shown).

At the same time, the further roller 711 which is configured as leading with respect to the roller 210, arranged vertically above said roller 711, by a schematically illustrated lever mechanism 712, presses against the locking skate angle 706 (see FIG. 8*c*, FIG. 7*c*). In so doing, the locking skate angle 706 transmits the resulting lifting force onto the driving roller 704 via the driving lever 705, as can be seen in particular from FIGS. 8*c* and 9*c*.

The lifting force is further transmitted from the (extensible) driving roller 704 onto the locking lever 703 (not extensible). The locking lever 703 transmits the force onto the connecting rod 702 which actuates the hook bolt 701 (FIG. 8*c*), thereby unlocking the lift car door.

To ensure this transmission of force, the non-extensible elements 101, 102 and 103 as well as the extensible elements 104, 105, 106, 107 of the lift car door lock are connected together or can be pivoted relative to one another by radial bearings. Some of these radial bearings are shown purely schematically and are identified by reference numeral 720.

The lift car door lock is expediently configured such that, during a subsequent folding or uncoupling of the coupling device, it locks the lift car door again as a result of its own weight.

Analogously to the device, described above in detail, for coupling a lift car door with a shaft door of a lift, it proves to be particularly advantageous in the case of the described lift car door locking mechanism that due to its extensibility, a maximum spacing between components on the lift car door side and components on the shaft side can be realised. Thus, when a lift car door lock is provided, the effective threshold spacing, i.e. the spacing between components on the lift car door side and components on the shaft door side can also be maximised during the travel of the lift car.

A further advantage is the relatively simple adjustment of the components, since only one component on the lift car door side (locking skate angle 706) comes into contact with only one component on the shaft door side (roller 711) for the entire lift car door lock.

The illustrated lift car door lock is characterised in that it is integrated into the device for coupling a lift car door and a shaft door such that it also uses the movements functions thereof (extending, widening, folding, retracting) in order to realise its own functions (extending, unlocking, locking, retracting).

We claim:

1. A device for entraining a shaft door with a lift car door, wherein the lift car door is actuated by a door drive, the device comprising catch means (110) provided on a lift car door side and counter-catch means (210) which are provided on a shaft door and that can be acted on by the catch means (110) to entrain the shaft door, characterised in that the catch means (110) and/or the counter-catch means (210) can be at least partly submerged into the lift car door and the shaft door respectively;

characterised in that the catch means (110) are initially moved vertically and then parallel to threshold leading edges (150, 160) of the lift car door and shaft door when they act on the counter-catch means (210).

2. The device according to claim 1, characterised by a carriage (102) on the lift car side which is moved on a lift car door by a drive (101), the carriage (102) being configured with rollers (108) that move during displacement by a connecting link (109a) of a guide unit (109), the catch means (110) being coupled with the guide unit such that a movement of the rollers (108) through the connecting link (109a) results in an extending of the catch means (110) with respect to the lift car door.

3. The device according to claim 2, characterised in that the drive is configured to be self-locking.

4. The device according to claim 2, characterised in that the drive is configured to be programmable.

5. The device according to claim 2, characterised in that the carriage (102) has a driver (10) that acts on a lever provided on the catch means (110), thereby causing the catch means (110) to spread apart.

6. The device according to claim 2, characterised in that the drive provides a single-dimensional movement which is converted into a complex movement by mechanical means.

7. The device according to claim 1, characterised in that the catch means (110) are configured to be extensible and can be at least partly submerged into the shaft door to act upon the counter-catch means (210).

8. The device according to claim 1, characterised in that the catch means (110) are configured as expander skate angles.

9. The device according to claim 1, characterised in that the counter-catch means (210) are configured as rollers provided on the shaft door.

10. A lift comprising a device for entraining a shaft door with a lift car door, wherein the lift car door is actuated by a door drive, the lift comprising: catch means (110) provided on a lift car door side and counter-catch means (210) which are provided on a shaft door and that can be acted on by the catch means (110) to entrain the shaft door, characterised in that the catch means (110) and/or the counter-catch means (210) can be at least partly submerged into the lift car door and the shaft door respectively; and characterised in that the catch means (110) are initially moved vertically and then parallel to threshold leading edges (150, 160) of the lift car door and shaft door when they act on the counter-catch means (210).

11. The device according to claim 2, characterised in that the drive is configured to be non-self-locking.

* * * * *